US008256890B2

(12) United States Patent
Bauer

(10) Patent No.: US 8,256,890 B2
(45) Date of Patent: Sep. 4, 2012

(54) DEVICE FOR PRINTING A COMPONENT BY MEANS OF A DIGITAL PRINTING METHOD

(75) Inventor: Joerg R. Bauer, Weingarten (DE)

(73) Assignee: Interglarion Limited, Nikosia (CY)

( * ) Notice: Subject to any disclaimer, the term of this patent is extended or adjusted under 35 U.S.C. 154(b) by 365 days.

(21) Appl. No.: 12/599,447

(22) PCT Filed: Apr. 29, 2008

(86) PCT No.: PCT/EP2008/003471

§ 371 (c)(1),
(2), (4) Date: Nov. 9, 2009

(87) PCT Pub. No.: WO2008/138489

PCT Pub. Date: Nov. 20, 2008

(65) Prior Publication Data

US 2010/0302304 A1 Dec. 2, 2010

(30) Foreign Application Priority Data

May 9, 2007 (DE) ..... 10 2007 021 765

(51) Int. Cl.
*B41J 2/01* (2006.01)
*B41J 2/015* (2006.01)

(52) U.S. Cl. ..... 347/104; 347/20

(58) Field of Classification Search ..... 347/20
See application file for complete search history.

(56) References Cited

U.S. PATENT DOCUMENTS

| | | | | |
|---|---|---|---|---|
| 5,477,244 | A * | 12/1995 | Shibata et al. | 347/19 |
| 5,815,282 | A | 9/1998 | Kano | |
| 6,705,701 | B2 * | 3/2004 | Samii | 347/42 |
| 6,769,357 | B1 | 8/2004 | Finan | |

FOREIGN PATENT DOCUMENTS

| | | | |
|---|---|---|---|
| CH | 695 555 | A5 | 6/2006 |
| DE | 200 07 200 | U1 | 7/2000 |
| EP | 1 038 689 | A | 9/2000 |
| JP | 2000 006493 | | 1/2000 |
| JP | 2001 270096 | A | 10/2001 |

* cited by examiner

*Primary Examiner* — Stephen Meier
*Assistant Examiner* — Alexander C Witkowski
(74) *Attorney, Agent, or Firm* — Greenblum & Bernstein, P.L.C.

(57) ABSTRACT

A device for printing at least one component using a digital printing method includes at least one print bar with a plurality of spray nozzles for electronically controlled spraying of coloring liquid and at least one holding device structured and arranged for holding the at least one component. Additionally, the device includes a transport device for generating a linear relative motion between the at least one print bar and the at least one holding device directed approximately perpendicular to a spray direction of the plurality of spray nozzles and a control device, with which the transport device and the plurality of spray nozzles can be controlled such that the at least one component is printed with a predetermined pattern. Further, the device includes a rotation device controllable by the control device, and structured and arranged to rotate the at least one component through about an axis, which is tilted to the spray direction of the spray nozzles.

14 Claims, 8 Drawing Sheets

I
II
A
B
C
10
12
14
16
18
22
24
26
28

20
B
A
12
46
48
10
11

A
B
10
12
20
24
50
52
54
56

FIG 14
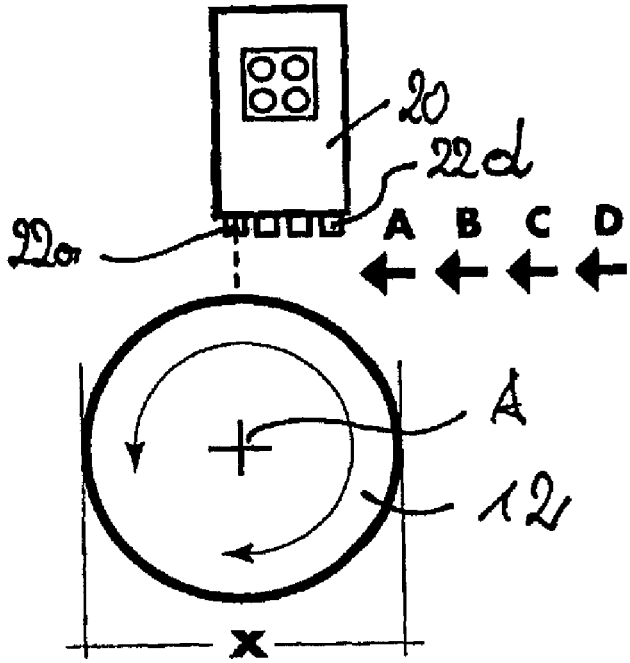
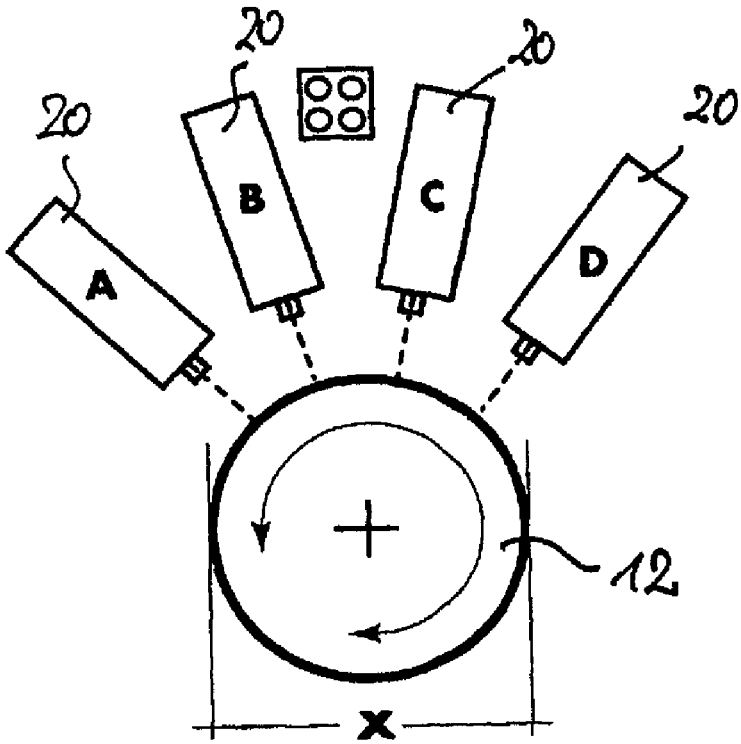
FIG 15

DEVICE FOR PRINTING A COMPONENT BY MEANS OF A DIGITAL PRINTING METHOD

CROSS REFERENCE TO RELATED APPLICATIONS

The present application is a U.S. National Stage of International Application No. PCT/EP2008/003471 filed Apr. 29, 2008, which published as WO 2008/138489 A1 on Nov. 20, 2008, the disclosure of which is expressly incorporated by reference herein in its entirety. Further, this application claims priority under 35 U.S.C. §119 and §365 of German Application No. 10 2007 021 765.1 filed May 9, 2007.

BACKGROUND OF THE INVENTION

1. Field of the Invention

The invention relates to a device for printing a component by a digital printing method.

2. Background Description

With the further development of electronic data processing, in particular of graphics programs, components comprising a wide variety of materials are increasingly being printed by digital printing methods in order to provide them with predetermined patterns that provide them, for example, with a high quality appearance. In order to produce components of this type cost-effectively in large production runs, printing devices are necessary that make high printing sets cost-effectively possible, even when printing components with surface areas tilted towards one another.

In the present application, a digital printing method is understood as printing methods in which a liquid in the form of individual droplets of liquid is sprayed from at least one spray nozzle onto individual surface elements of a surface to be printed with electronic control by at least one digital data record in order to produce a predetermined pattern on the surface, which pattern can also have the appearance of a homogeneous coloring. Different colors can be produced by different coloring liquids that are sprayed in the form of droplets onto a surface element or directly adjacent surface elements. Different coloring intensities can be produced by the number of droplets reaching a surface element or directly adjacent surface elements and/or—recently—by different volumes of the droplets of liquid. A typical example of a digital printing method is the so-called inkjet printing method, in which droplets of ink or coloring liquid are sprayed from a print head with several spray nozzles. The droplets are produced and sprayed by thermal evaporation (bubble jet) or with the aid of piezoelectric elements.

A printing device with a transport unit is known from U.S. Pat. No. 5,815,282, on which a plurality of components to be printed are arranged next to one another and one behind the other. A bar extends transversely over the transport unit, which bar is adjustable in height and along which a nozzle head with several ink nozzles can be moved. The bar is adjustable in height so that components with surface areas of different heights can also be printed.

A device for printing objects located on a transport device moved in a linear manner is known from EP 1 038 689 A, which contains several stationary nozzle bars extending transversely over the transport device. Each nozzle bar is equipped with ink nozzle heads such that it is possible to print therefrom objects located on the transport device over the entire width thereof.

SUMMARY OF THE INVENTION

The aim of the invention is to create a device for printing components by a digital printing method, with which components with three-dimensional surfaces with areas very tilted towards one another can also be printed.

This aim is attained with a device for printing a component by a digital printing method, containing a print bar with a plurality of spray nozzles for the electronically controlled spraying of coloring liquid, a holding device for holding the component, a transport device for generating a linear relative motion directed approximately perpendicular to the spray direction of the spray nozzles between the print bar and the holding device, and a control device, with which the transport device and the spray nozzles can be controlled such that the component can be printed with a predetermined pattern, characterized in that a rotation device that can be controlled by the control device is provided, with which rotation device the component can be rotated about an axis tilted to the spray direction of the spray nozzles.

With the rotation device provided according to the invention, with which one or more components arranged on the transport device can be rotated about an axis tilted to the spraying direction of spray nozzles, it is also possible to print components with three-dimensional surfaces, which have surface areas that are very tilted towards one another. The printing is preferably carried out thereby such that initially with the rotation device at rest, a surface area that is approximately orthogonal to the spraying direction of the spray nozzles is printed, the component or components are then rotated and in a further printing step one or more surface areas are printed, which after the rotation of the component or components are orthogonal to the spraying direction of the spray nozzles. In another operating mode the rotation device can be actuated during the printing with a stationary transport unit. It is also possible to jointly actuate the turning device and the transport unit during printing.

The subordinate claims are directed to advantageous embodiments and further developments of the device according to the invention.

As characterized by one embodiment of the device according to the invention in which two consecutive printing steps are carried out with opposite relative motion between the component or components and the spray nozzles so that the same spray nozzles can be used for both consecutive printing steps.

In another embodiment, a sequence in which the direction of the relative motion between the spray nozzles and the component or components does not change between two consecutive printing steps, so that different spray nozzles are used for consecutive printing steps.

Further embodiments related to further advantageous embodiments of the device are also described.

An embodiment of a the invention makes it possible for surface areas staggered in height to be printed.

According to another embodiment, the angle of rotation about which the component or components are rotated between two printing steps corresponds to the tilt angle between the surfaces to be printed in the two printing steps.

Further embodiments are directed to two advantageous arrangements of the rotation axis relative to the direction of the relative mobility between the intake device and the spray nozzles.

With the features of another embodiment, components with a circular cross section can be printed.

A still further embodiment of the device includes a plurality of components can be printed at the same time. These components are thereby preferably identical to one another.

Another embodiment is directed to a device that can be used particularly flexibly.

BRIEF DESCRIPTION OF THE DRAWINGS

The invention is explained below by way of example and with further details based on diagrammatic drawings.

The figures show.

DETAILED DESCRIPTION OF THE INVENTION

The digital printing method is referred to below for the sake of simplicity as a printing method, without the invention being restricted thereto.

Figures 1, 2, 3:
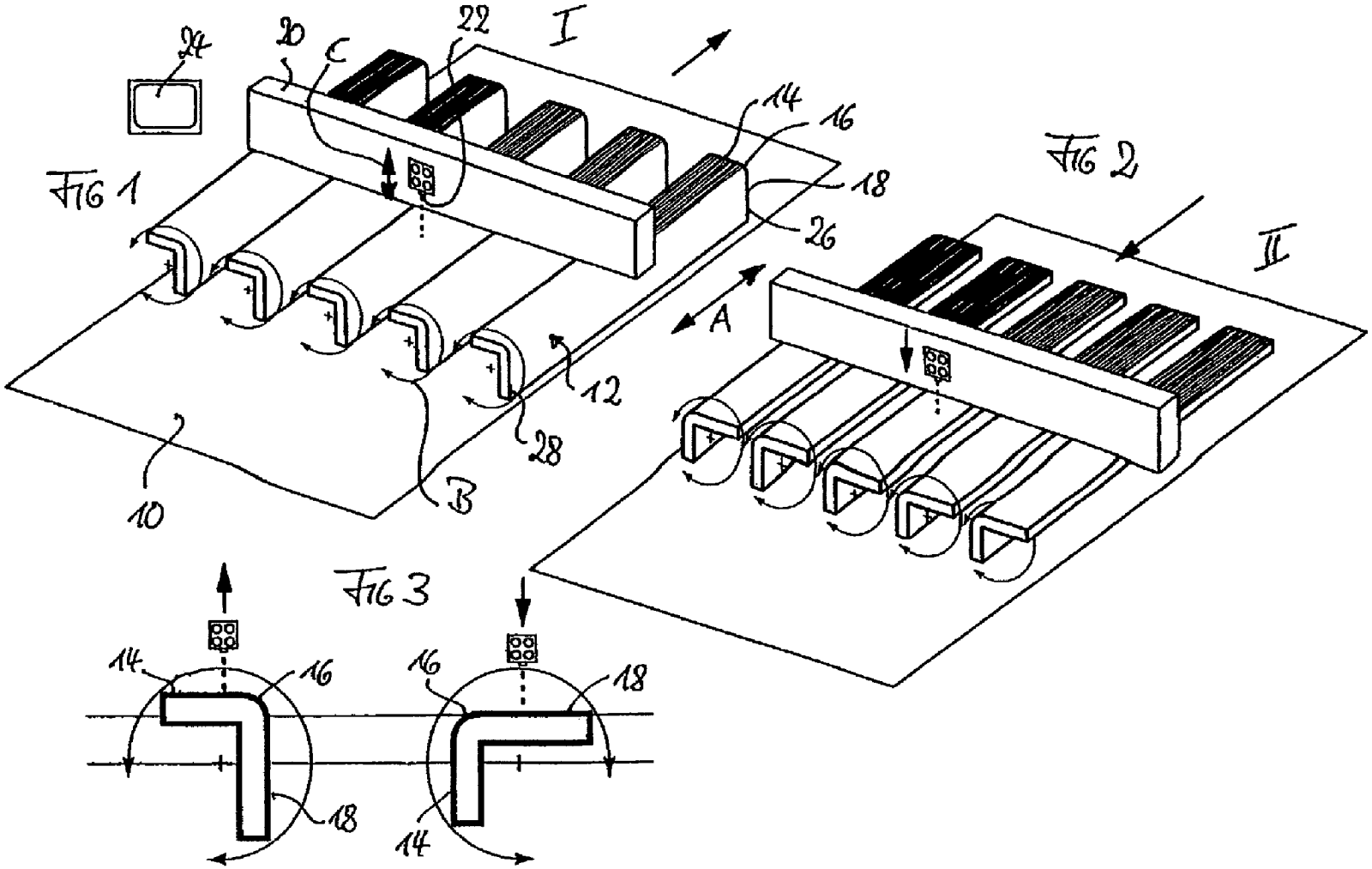
FIG. 1A perspective diagrammatic view of a first embodiment of a device according to the invention with a plurality of components to be printed, FIG. 2 A view corresponding to FIG. 1 with rotated components, FIG. 3 Partial views to explain the mode of operation of the device according to FIGS. 1 and 2, FIG. 4 A diagrammatic front view of the device according to FIG. 1 to explain a rotation device, FIGS. 5 and 6 The views corresponding to FIGS. 1 and 2 of a modified embodiment of the device according to the invention, FIG. 7 A perspective view of a further embodiment of a device according to the invention, FIG. 8 A partial view of FIG. 7 to explain a rotation device contained in the device according to FIG. 6, FIG. 9 A perspective view of a further embodiment of a device according to the invention, FIG. 10 A partial view of the rotation device contained in FIG. 10 to explain a device according to the invention according to FIG. 10, FIG. 11A side view of a conical component to be printed with print head and a sketch of the two-dimensional development of a pattern to be printed on the three-dimensional component, FIG. 12 An embodiment of a device according to the invention with which an elongated component with a three-dimensional surface can be printed with a single set of print bars, which print bars can be rotatable, FIG. 13 An embodiment of a device in which several elongated components can be printed simultaneously without reversing their motion relative to printing nozzles, FIG. 14 An embodiment of a print bar with which a component embodied with a circular cross section can be printed, and FIG. 15 An arrangement of several print bars, with which a component with circular cross section can be printed.
Figure 4:
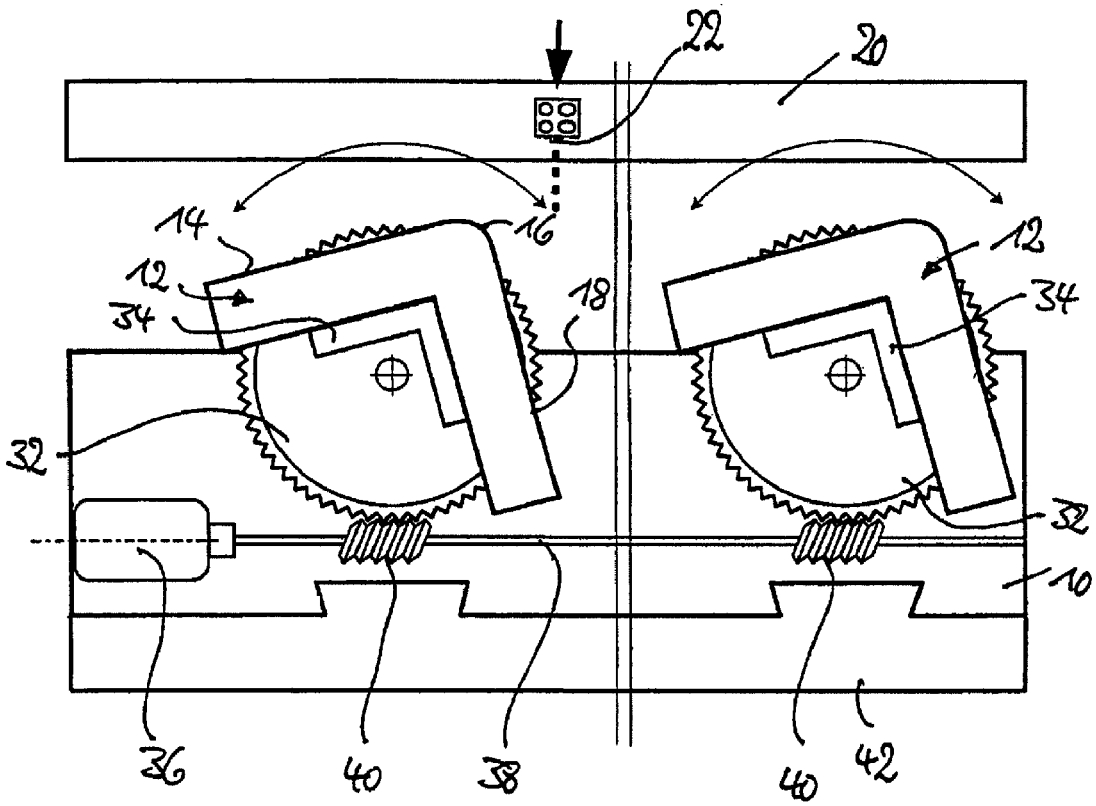

According to FIG. 1, a plurality of components 12 to be printed are arranged next to one another on a platform 10. As shown in FIG. 4, holding devices for the components 12 are arranged on the platform 10, which holding devices can be rotated or pivoted with a rotation device in the direction of the arrows B. In the example shown, the components 10 are profiles with constant cross section in their longitudinal direction, wherein a surface to be printed has a first region 14 that is flat overall and which merges via a transition region 16 curved by approximately 90 degrees into a second flat region 18, which is tilted by 90 degrees with respect to the first region.

The components 12 are arranged adjacently on the platform 10 transversely to the mobility direction of the platform 10, wherein, in the position shown, the first regions 14 form an area that is flat overall and is interrupted by the spacings between the components. The platform 10 can be moved to and fro in a linear manner in the direction of the double arrow A by a drive device (not shown), which can be known in design per se, and together with the drive device forms a transport device.

A print bar 20 extends transversely over the platform 10 transversely to the direction of the double arrow A and parallel to a plane formed by the platform 10, which printing bar 20 is provided on the underside thereof with spray nozzles 22 (indicated diagrammatically) along its length, which spray nozzles comprise an inkjet printing system that is known as a whole in its design, with which the spray nozzles 22 can be controlled such that a predetermined, electronically stored pattern can be printed on a surface. The print bar contains, for example, along its length a plurality of print heads arranged to overlap one another, so that all of the components can be printed precisely with predetermined patterns at the same time. The print bar 20 can be moved in the direction of the double arrow C perpendicular to the plane of the platform 10. A programmable electronic control device 24 is used to control the movement of the platform 10 in the direction of the double arrow A, the rotation of the components 12 about their longitudinal axis in the direction of the double arrow B and the movement of the print bar 20 in the direction of the double arrow C and to control the spray nozzles 22. Control device can be known in design per se and is therefore not described in detail. Different colors can be sprayed in a manner known per se with the spray nozzles 22, so that patterns of any type can be printed.

The function of the device is as follows:

The first regions 14, pointing upwards in FIG. 1, of the components 12 as well as a part of the transition regions 16 are printed simultaneously in a first printing step I, in that the platform 10 is moved through under the print bar 20, wherein the components 12 are printed in the direction from their front ends 26 towards their rear ends 28.

When the rear ends 28 have been reached, the components 12 are rotated by the rotation device by 90 degrees according to FIG. 1 in the counterclockwise direction so that the second regions 18 are facing upwards towards the print bar 20 and the already printed first regions are in a perpendicular position. FIG. 2 shows the device according to FIG. 1 with rotated components 12. FIG. 3 clarifies the relations. When the width of the first region and the second region is different, the print bar 20 is shifted in the direction of the arrow C such that according to FIG. 1 and FIG. 2 there is the same distance between the spray nozzles and the surface of the components to be respectively printed.

Subsequently, the platform 10 is moved backwards so that the second regions 18 and at least a part of the transition regions 16 are printed in a second printing step II starting from the rear ends 28 of the components 12 towards the front ends 26.

Naturally, the pattern to be printed on the components is stored in a distorted manner such that it appears undistorted in the printing of the three-dimensional transition region from the spray nozzles arranged in a two-dimensional manner. Furthermore, the transition region in the respective printing operation is advantageously printed only so far that the liquid droplets emitted by the spray nozzles strike the transition region at a sufficiently large angle and do not rebound or become too distorted. For example, in the respective printing operation, the part of the transition region that is tilted by less than 30 degrees to the spray direction of the spray nozzles is not printed. In the part of the transition region printed in both of the printing steps I and II (tilted between 30 degrees and 60 degrees), the quantity of the sprayed coloring liquid is controlled such that the total quantity of the coloring liquid sprayed in the two printing operations per surface unit is not different from the quantity that is emitted onto the flat regions.

The device described can be modified in various ways. For example, the components 12 do not necessarily need to be embodied with the same cross section along their length. When the surface regions to be printed in each case are not parallel to the surface of the platform 10, during the movement of the platform 10 the print bar 20 can be moved in the direction of the double arrow C, so that a consistent spacing is respectively obtained between the spray nozzles and the surface to be printed (with the exception of the transition region). Furthermore, the angle formed by the first region 14 and the second region 18 with one another can be different from 90 degrees. Furthermore, since the position of the individual components relative to the print bar or the spray nozzles in the control device 24 is known with the aid of output signals of suitable sensors, the components 12 can be printed with different patterns, although they are printed simultaneously. The components 12 do not necessarily have to be identical to one another. They should merely be spaced at the same distance from the print bar 20 with the surfaces to be printed in each case in the two rotation conditions according to FIG. 1 and FIG. 2. For example, side edges of the components can be embodied with recesses having different shapes. The shape of the components is stored in the control device 24, so that, even when they are different from one another, the individual surfaces can be printed in a targeted manner with predetermined patterns that likewise can be different from one another.

FIG. 4 shows in a diagrammatic front view of the device according to FIG. 1 an exemplary embodiment of a rotation or swivel device for turning the components 12. On each front face of the platform 10 (only the front side of the platform 10 is visible) a plurality of gear wheels 32 provided with external toothings are swivel-mounted about platform-fixed axes that run in the mobility direction of the platform and are connected to one another in a rotationally fixed manner via profiles 34 that are angled in the example shown. The profiles 34 serve as supports or holders for the components 12. An electric motor 36 is attached to the front side of the platform 10, which electric motor drives a shaft 38 that extends transversely over the front face of the platform 10 and is embodied with thread toothings 40, which mesh with the external toothings of the gear wheels 32. As is directly visible from the figure, the gear wheels 32, and with them the profiles 34, can be rotated by corresponding actuation of the electric motor 36 simultaneously and in the same direction of rotation as the rotation or swiveling of the components 12 supported on the profiles 34. Furthermore, according to FIG. 4, the platform 10 is guided on a guide part 42 in a longitudinally displaceable manner, wherein drives that are known per se can be used to displace the platform 10 in the direction of the double arrow A of FIG. 1. The guide part 42 can be much longer than platform 10 in the mobility direction of the platform 10, so that several platforms with corresponding rotation devices can be arranged one behind the other on the guide part 42. The rotation device described by way of example can be modified to accommodate and rotate components of different shapes in an expedient manner.

Figures 5, 6:
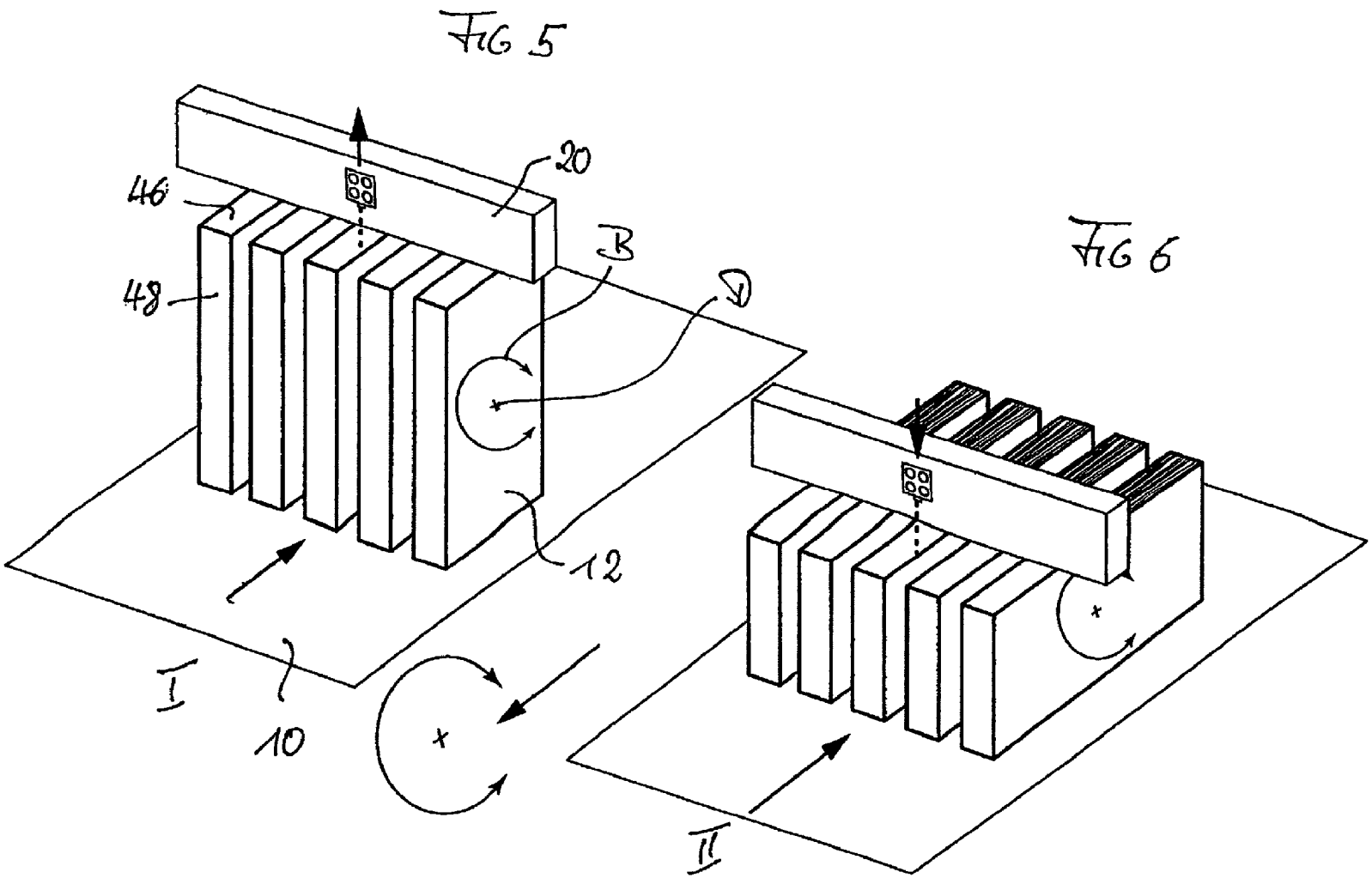

FIGS. 5 and 6 show an embodiment of the device which is similar overall to that of FIGS. 1 and 2. The difference is that the rotation device for rotating the components 12 rotates the components in the direction of the double arrow B about an axis D which is directed in a parallel manner to the longitudinal extension of the print bar 20. In this manner the tops 46 of the components 12 are printed in a first printing step, the front faces 48 are printed in a second printing step, wherein the movement of the platform 10 in the direction of the double arrow A occurs according to the respective length of the tops and the front faces. When the components 12 are to be printed around their narrow sides, four printing operations take place, between which the components are rotated by 90 degrees in each case. To ensure that the edges of the components 12 according to FIG. 4 are not printed with an inadmissibly excessive amount of liquid, the spray nozzles are controlled precisely such that a spray nozzle that projects beyond an edge no longer emits any coloring liquid.

In the embodiment with the device according to FIGS. 1 and 2 as well as with that according to FIGS. 5 and 6, the angle of rotation about which the components are rotated after a printing step has been completed, and the number of rotations that are necessary for the complete printing of a component depend on the number of the surface regions adjacent to one another and their angle to one another. The control of the ink quantity sprayed from the spray nozzles at the end of the respective printing step (FIGS. 5 and 6) or at the edge areas of the surface to be printed in the respective printing step (FIGS. 1 and 2) depends on the type of transition area, e.g., radius of curvature, angle at circumference, etc.

Components with a round cross section, for example, a circular cross section, can also be printed with the embodiments previously described, in that the components are rotated by an angle after a printing step in each case, wherein the patterns are applied in the individual printing steps such that a circumferential part of the surface or the entire circumferential surface is printed with a predetermined pattern in a predetermined intensity.

Alternative embodiments of the device according to the invention for the simultaneous printing of several components that are embodied with a circular cross section are explained based on the following FIGS. 7 through 10.

Figures 7, 8, 9, 10:
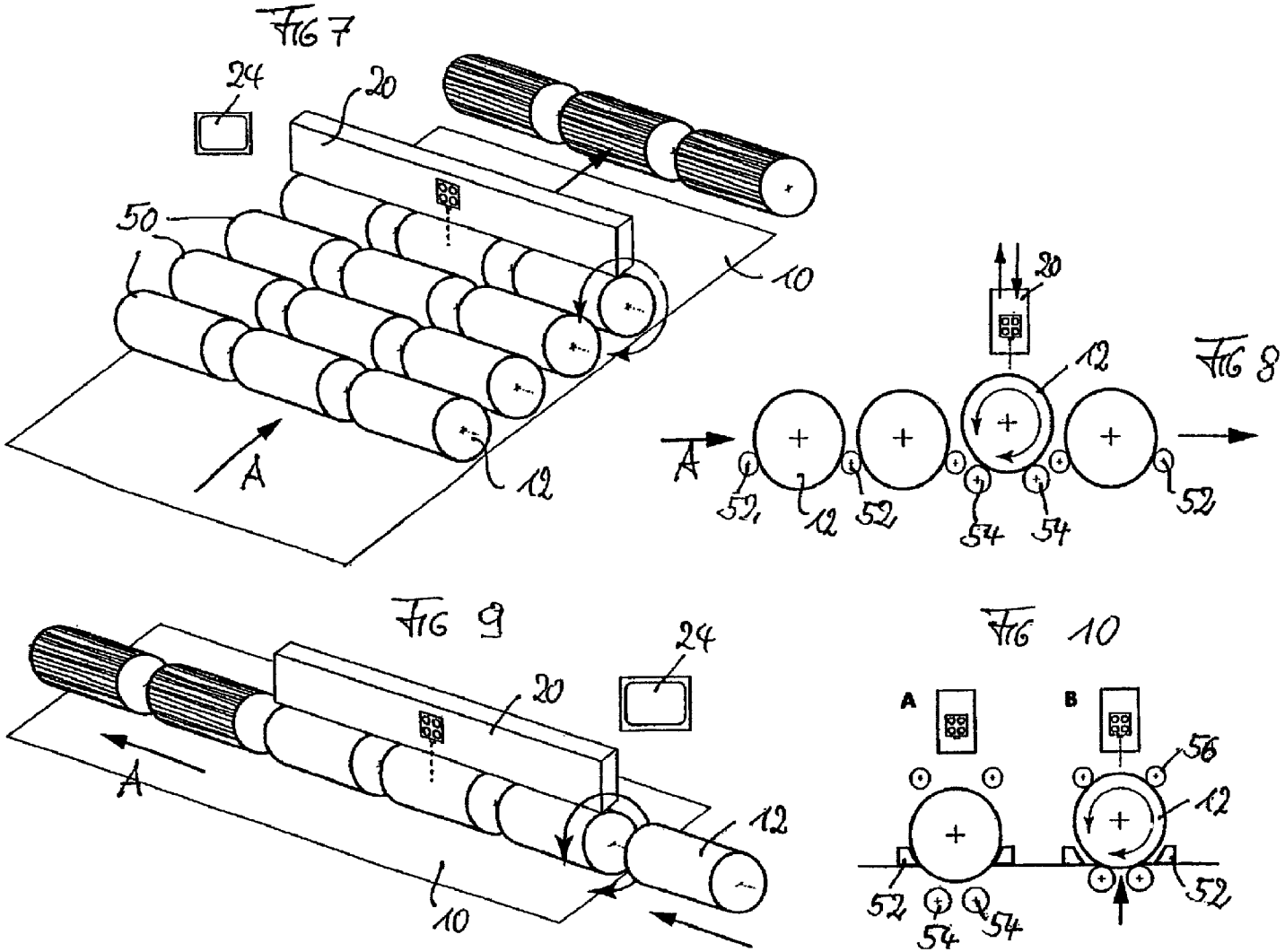

According to FIG. 7, on the platform 10 that can be moved in the direction of the arrow A cylindrical components 12 are arranged in rows 50 arranged next to one another with respect to the mobility direction of the platform 10, and the components are arranged in a row one behind the other parallel to the extension direction of the print bar 20. The rotation device (not shown) with which the components 12 embodied with a circular cylindrical consistent cross section can be rotated, is embodied such that the components respectively located under the print bar 20 can be rotated when the platform 10 is stationary.

According to FIG. 8, which shows a perpendicular section in the direction of the arrow A through the device according to FIG. 7, the components 12 are held in a stationary manner on the platform 10 between stationary rollers or other holders 52. The components 12 are transported in the direction of the arrow A successively in each case. As soon as a row 50 of the components 12 is arranged under the print bar 20, transport rollers 54 that can be rotationally driven move in the direction of the print bar 20 and raise the components 12 located thereon so that the components 12 are rotated about their axis as soon as the transport rollers 54 are rotationally driven. During this rotation the surfaces of the rotated components 12 are printed with the predetermined patterns. After the entire surface or a predetermined surface region of the components 12 has been printed, the rotary drive of the transport rollers 54 is ended and the following row of components is moved under the print bar 20.

FIGS. 9 and 10 show a modified embodiment of the device according to FIG. 7. In this case, a row of circular cylindrical components 12 is arranged on the platform 10 one behind the other aligned coaxially to one another in the transport direction A. The longitudinal direction of the print bar 20 is parallel to the transport direction A and the print bar is located above the components 12 in a position such that the ink nozzles are spaced at an equal distance from the components and the exit direction of the liquid from the spray nozzles 22 is approximately perpendicular to the surface of the components 12.

The components 12 are transported successively in each case such that unprinted components are located under the print bar 20. The transport in the direction of the arrow A is then interrupted and the components 12 located under the print bar 20 are then raised by transport rollers 38 that can be rotationally driven, and are rotationally driven so that they can be printed.

According to FIG. 10, the transport rollers 54 have a smaller lateral spacing from one another compared to the embodiment according to FIG. 8, so that the components 12 for the reliable rotational drive thereof are pressed against loose rotatable support rollers 56.

With the arrangements previously described, not only can components embodied with a circular cylindrical cross section, for example, cans, be printed but also components embodied with an elliptical cross section, wherein the print bar 20 is advantageously moved during the rotation of the components such that the spacing between the spray nozzles and the surface of the components to be printed remains constant.

The transport device does not necessarily have to have a platform 10, instead the individual components can be accommodated in holders that can be displaced in guides in a longitudinal manner and that are driven by a transport belt.

Figure 11:
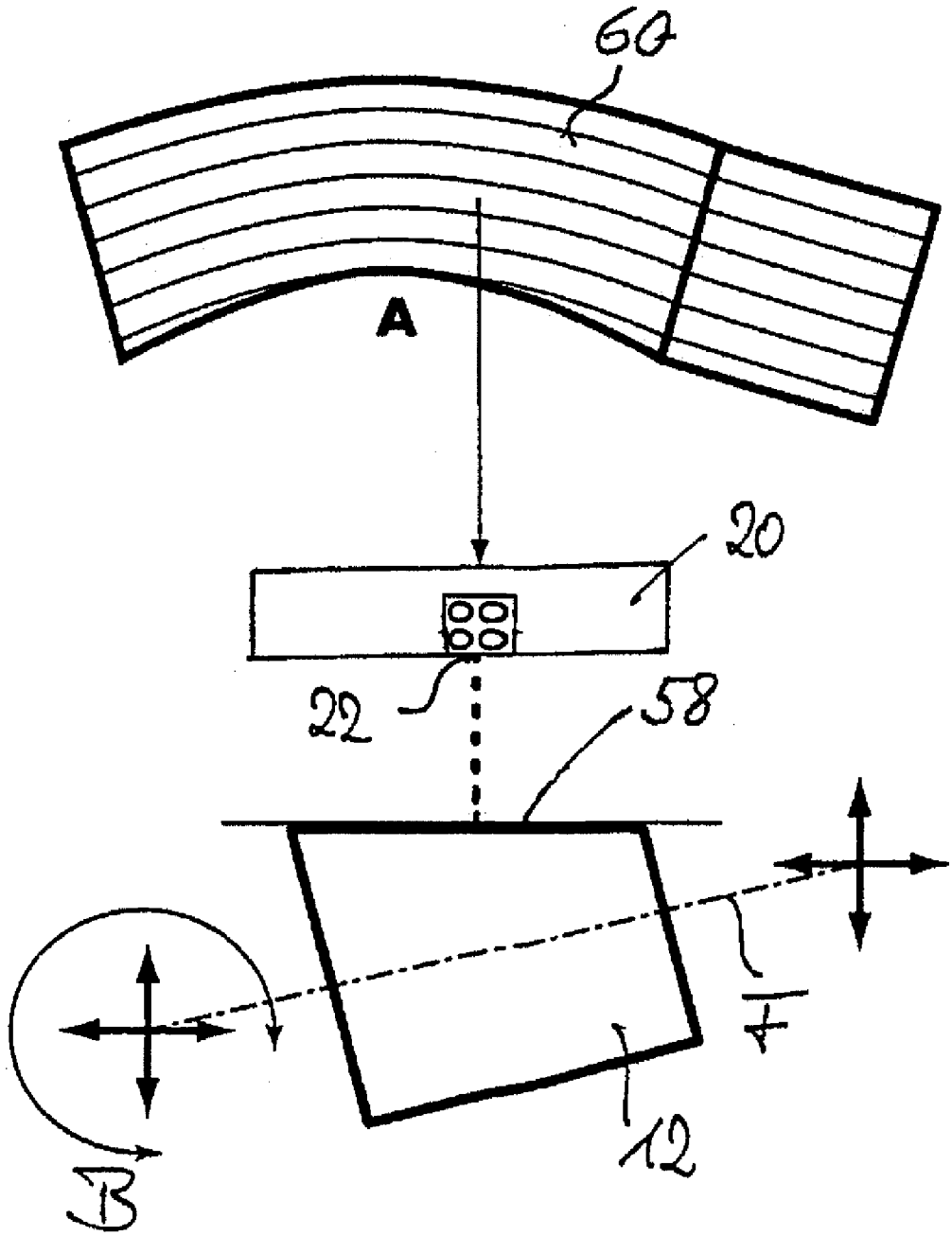

FIG. 11 shows an embodiment in which the components 12 to be printed are embodied in a conical or other manner such that during rotation about an axis F in the direction of the double arrow B and optionally additional pivoting of the axis F, they can be arranged such that a surface region 58 respectively extends parallel to the longitudinal extension of the print bar at the same distance from the ink nozzles thereof. In this manner even components 12 with complex shapes can be printed when the transport device (platform 10) is provided with corresponding rotational and pivoting devices for the components 12 to be printed, wherein the pattern 60 to be printed on the three-dimensional surface of the components 12 is correspondingly distorted in its two-dimensional storage for the control of the ink nozzles. A component 12 that can be printed according to FIG. 12 is, for example, a heel of a lady's shoe, wherein the surface thereof can additionally be concave, so that only axial surface lines of the surface thereof run parallel to the print bar, but the distances of the individual surface elements from the spray nozzles of the print bar can be displaceable.

Figure 12:
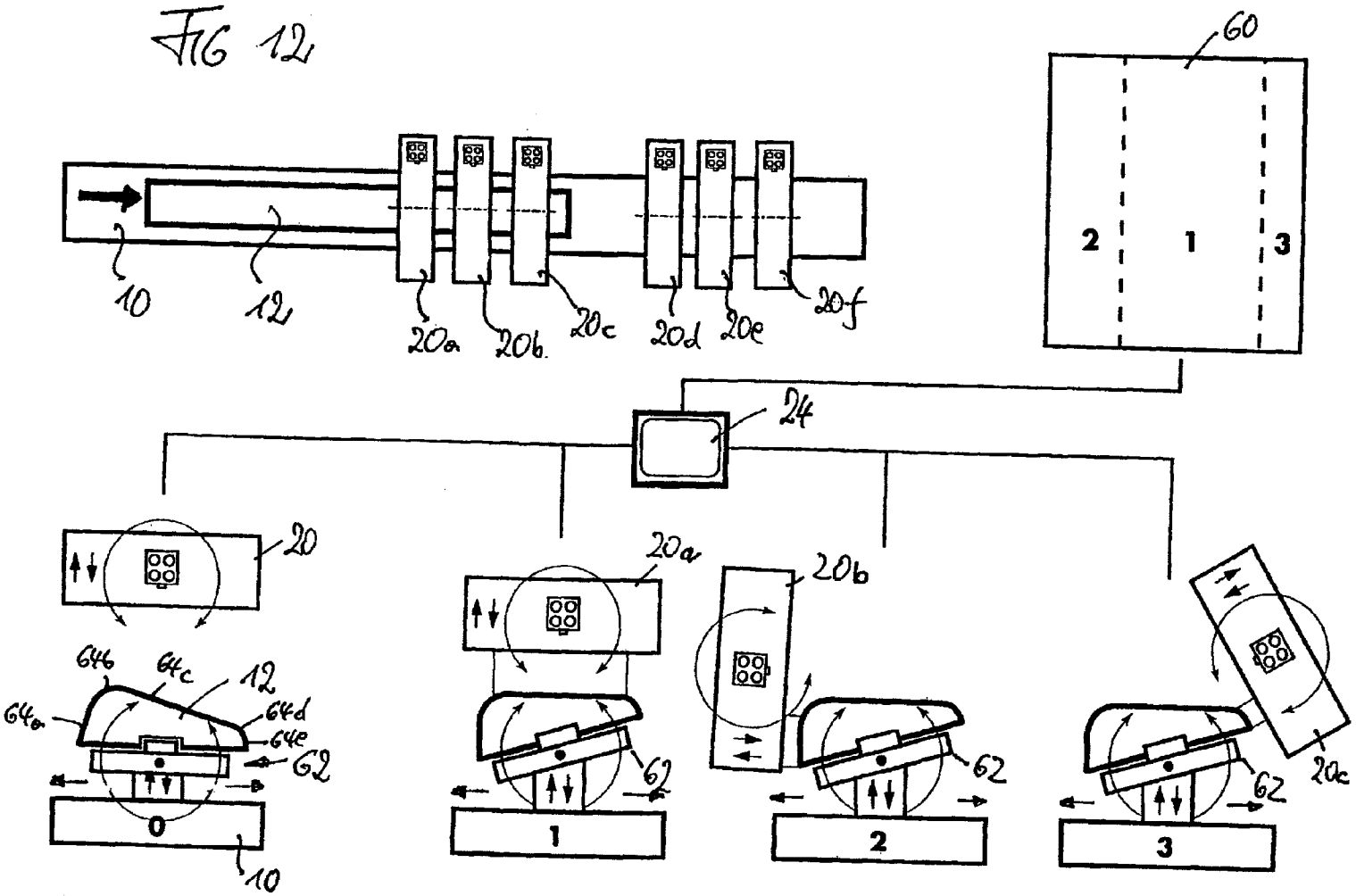

FIG. 12 shows an embodiment of a device according to the invention in which only one longitudinal component 12 with preferably constant cross section over its length is arranged on the platform 10, which can be moved along the arrow by a conveyor or drive (not shown), for example, a roller conveyor. Nozzle bars 20*a* through 20*d*, which can contain only one print head in each case, with which the entire width of the components 12 can be printed, extend transversely over the platform 10. It should be noted here that in the simplest case the print bars, depending on their length, can be provided with a row of ink nozzles that extend over their length in a longitudinal manner and can be selectively actuated and can be selectively loaded with different coloring liquids, or they can be provided with several rows of spray nozzles arranged next to one another which can be actuated selectively and each row of which is assigned to a coloring liquid or application liquid. The spray nozzles can be combined to form groups, wherein each group is assigned, for example, to a print head, and the optionally several print heads covering the length of the print bar are actuated by an electronic control device in a manner known per se. In a short embodiment a print bar can contain only one print head 5, so that then the terms print bar and print head are used synonymously.

With reference to FIG. 12 again, the top left part of which shows a view of the device, the component 12 on the platform 10 is held in a holding device 62, which is adjustable in height as well as pivotable. The print bars 20 are also adjustable in height and pivotable. The pivot axis about which a component 12 held by the holding device 62 can be pivoted and the pivot axis about which the print bars 20 can be pivoted are parallel to the mobility of the platform 10.

As can be seen from the cross section of the component 12, this has five surface regions 64*a* through 64*e*, wherein a first flat surface region 64*a* merges via a curved region 64*b* into a second flat surface region 64*c*, which in turn merges via a curved transition region 64*d* into an approximately flat end region 64*e*. The surface regions are tilted differently to a reference plane, for example, a horizontal plane directed parallel to the mobility direction of the platform 10.

The pattern to be applied to the surface regions is shown developed and labeled as a whole by 60. The electronically stored pattern is divided into three regions 1, 2 and 3, wherein the region 1 corresponds to the surface region 64*c* and is assigned to the print bar 20*a*, the pattern region 2 represents the surface region 64*a* and is assigned to the print bar 20*b* and the pattern region 3 represents the surface region 64*e* and is assigned to the print bar 20*c*.

The four different positions of the device at the bottom in FIG. 12 are as follows:

The position labeled 0 is the rest position of the holding device 62, in which the component 12 is moved towards the print bar 20. As soon as the front end of the component 12 approaches the print bar, the holding device 62 is moved into the right position shown in three parts in FIG. 12, in which the component 12 is pivoted such that it is arranged lying opposite the horizontal print bar 20*a* in a horizontal position at a predetermined printing distance. The print bars 20*b* and 20*c* are pivoted such that they are located in each case parallel to the surface regions 64*a* and 64*e* lying opposite thereto at a predetermined printing distance. The component 12 then moves further through under the print bars 20*a* through 20*c* and is printed by these print bars at the same time. After the pattern has been printed, the component moves through under the print bars 20*d* through 20*f*, which are arranged according to the print bars 20*a* through 20*c* and which provide the surface of the component 12 printed with the pattern with a protective layer of durable transparent varnish, for example.

The transition regions between the pattern regions 1 and 2 as well as 1 and 3 are shown by broken lines in FIG. 12. Naturally, the respective transitional area 64*b* or 64*d* is preferably printed by both print bars 20*a* and 20*b* or 20*a* and 20*c*, wherein the quantity of liquid emitted by the print bar 20*a* in the transition regions 64*b*, 64*d* decreases from the surface region 64*c* to the surface regions 64*a*, 64*e* and the quantity of liquid emitted by the adjacent print bars 20*b* or 20*c* decreases in the direction towards the surface region 64*c*, so that the transition regions are printed with the same color intensity as the flat surface regions.

With the device described, in which the print bar as well as the holding device can be moved in a linear manner and pivoted, wherein the holding device or the print bar in addition can be movable transversely to the mobility direction of the platform 12, an extraordinarily flexible use of the device is achieved, with which various components can be printed with a high throughput. The components do not necessarily need to be embodied with a constant cross section along their length. In the case of changes in cross section, the print bars or the holding device can be moved such that the predetermined optimum printing conditions are maintained. The largest or most important surface region in each case can be printed in a horizontal position in which the best printing results are obtained.

The maneuverabilities of the print bars and the holding device do not need to be present in all of the dimensions described, but can be embodied expediently only to carry out the respective printing function.

In the embodiment described the entire surface of a component to be printed could be printed by the device in one pass. In an alternative embodiment of the device, the three print bars 20*a*, 20*b*, 20*c*, for example, can be loaded with only one coloring liquid in each case, so that only one surface region and the adjacent transition regions of the component are printed in one pass through the device. When the component is subsequently moved backwards through the device, after tilting a further surface region can be printed and subsequently the third surface region can be printed with a pass through the device again in the opposite direction. When all of the coloring liquids are sprayed with one print bar, only one moveable print bar is necessary for this embodiment of the device, in which a multiple pass of the component takes place. The downstream print bars 20*d* through 20*f* can likewise be replaced by a single print bar or they can be omitted completely, if the protective liquid can also be sprayed from the print bar from which color liquid can be sprayed.

The printing of the component 12 can take place in particular in the region of the transition regions in a larger number of steps in which the component in each case is moved through under one or more print bars, wherein only a narrow strip is printed in each individual step. It is also possible to carry out the printing such that the component 12 is moved in a zigzag manner through longitudinal movement of the platform 10 and transverse movement of the actuating device 62 and is thereby tilted at the same time relative to the print bar or print bars and is held at a constant distance from the print bars so that the printing takes place in one step with complex relative movement between the print bar and the component to be printed.

Figure 13:
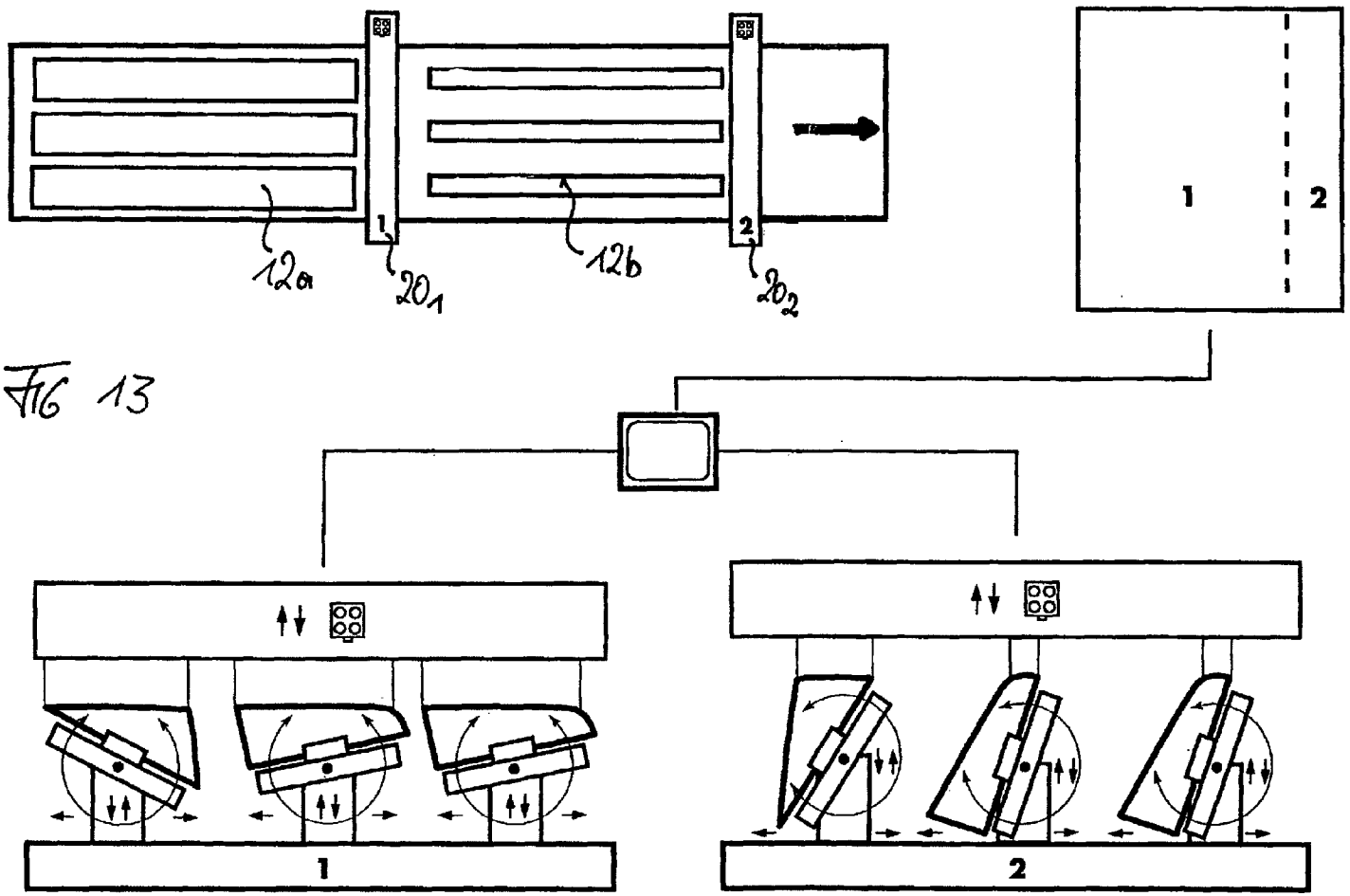

FIG. 13 shows an embodiment of a device in which print bars 20 are spaced apart from one another along the length of the platform 10 by at least the length of the components 12 so that after printing by a print bar or by the print bars of a first group of print bars the components can be pivoted into a new rotational position and then can be printed with a further print bar or a further group of print bars so that no opposite relative movement between the print bars and the component to be printed is necessary between individual printing steps. Thus, the throughput rate can be considerably increased. Moreover, in the device according to FIG. 13, as with the device, for example, according to FIGS. 1 and 2, several components are arranged next to one another on the platform 10 which can be moved individually with their holding devices 62.

Naturally, the embodiment according to FIGS. 1 and 2 can also be embodied such that several print bars 20 are arranged spaced apart from one another in the direction of movement of the platform 10 so that the direction of movement of the platform 10 does not need to be reversed between the individual printing steps, which renders possible a much higher throughput of components and thus of area to be printed.

FIG. 14 shows a cross section through a print bar 20 and a component 12 with circular cylindrical cross section according to an arrangement, for example, of FIGS. 7 and 9. It is assumed that the nozzle bar 20, which extends parallel to the rotation axis A of the component 12, has four ink nozzle rows 22*a* through 22*d* arranged next to one another (only the first and the last ink nozzle row have been provided with reference numbers). The distance between adjacent spray nozzle rows is generally small compared to the diameter x of the component 12. Depending on the geometric conditions, as can be seen from FIG. 14, the distance between the row of ink nozzles 22*a* and the surface of the component 12 can be so much smaller than the distance of the ink nozzles 22*b* from the surface of the component 12 that the precision with which ink droplets sprayed from the ink nozzles 22*d* reach the surface of the component 12 is impaired. In this case it is advantageous if the individual spray nozzle rows are activated successively and the component 12 is moved between two spray steps in each case by a distance between adjacent spray nozzle rows relative to the nozzle bar 20, as shown by the arrows A, B, C and D. In this manner the print quality remains unchanged.

While in the embodiment according to FIG. 14 the individual spray nozzle rows 22*a* through 22*d* are actuated successively, FIG. 15 shows an embodiment in which four different nozzle bars 20A through 20D are arranged radially to the component 12 with circumferential spacing, which nozzle bars can be activated simultaneously to print the component 12. Naturally, the nozzle bars 20A through 20D can be combined to form a single nozzle bar. In the case of a high circumferential speed of the rotating component 12, it can be advantageous if the ink jets do not reach the surface of component 12 perpendicularly but with a component motion in the circumferential direction that corresponds to the circumferential speed of the surface.

Features of the embodiments described above can be combined with one another in a different manner. For example, in the embodiment of the device according to FIG. 12, a printed component can also perform a pivoting motion during the printing.

REFERENCE NUMBERS

10 Platform
11 Center line
12 Components
14 First region
16 Transition region
18 Second region
20 Print bar
22 Spray nozzles
24 Electronic control device
26 Front end
28 Rear end
32 Gear wheel
34 Profile
36 Electric motor
38 Shaft
40 Thread toothing
42 Guide part
46 Tops
48 Front faces
50 Row
52 Holder
54 Transport rollers
56 Support rollers
58 Surface region
60 Pattern
62 Holding device
64 Surface region

The invention claimed is:

1. A device for printing at least one component using a digital printing method, comprising:

at least one print bar with a plurality of spray nozzles for electronically controlled spraying of coloring liquid;

at least one holding device structured and arranged for holding the at least one component;

a transport device for generating a linear relative motion between the at least one print bar and the at least one holding device in a direction approximately perpendicular to a spray direction of the plurality of spray nozzles;

a control device structured and arranged to control the transport device and the plurality of spray nozzles in order to print the at least one component with a predetermined pattern; and a rotation device controllable by the control device, and structured and arranged to rotate the at least one component about an axis tilted with respect to the spray direction of the spray nozzles.

2. The device according to claim 1, wherein the control device controls the transport device, the rotation device and the plurality of spray nozzles such that a rotation position of the at least one component during a printing operation is constant with a relative motion relative to the plurality of spray nozzles, the at least one component is subsequently rotated by a predetermined angle amount and the rotation position of the at least one component during a further printing operation is constant with an opposite relative motion relative to the plurality of spray nozzles.

3. The device according to claim 1, wherein:

the at least one print bar comprises a plurality of print bars arranged one behind another in the direction of the relative motion between the transport device and the plurality of print bars, the control device controls the transport device, the rotation device and the plurality of spray nozzles such that the rotation position of the component during a printing operation is constant with relative motion relative to a print bar of the plurality of print bars, the at least one component is subsequently rotated by a predetermined angle amount and the rotation position of the at least one component during a further printing operation is printed by a further print bar of the plurality of print bars with a continuation of the relative motion.

4. The device according to claim 1, wherein the transport device is stationary during a printing operation and the rotation device rotates the at least one component during the printing operation.

5. The device according to claim 1, wherein the transport device and the rotation device are active during a printing operation.

6. The device according to claim 1, wherein the print bar is moveable relative to the at least one component such that a distance between a surface region of a just-printed component and the ink nozzles is constant, as compared to a distance between the surface region of a currently-printed component and the ink nozzles.

7. The device according to claim 1, wherein:

the at least one component comprises at least two surface regions tilted towards one another by a tilt angle, and the angle of rotation is equal to the tilt angle.

8. The device according to claim 1, wherein the rotation axis is parallel to the direction of relative motion between the at least one print bar and the holding device.

9. The device according to claim 1, wherein the rotation axis is perpendicular to the direction of relative motion between the at least one print bar and the holding device.

10. The device according to claim 1, wherein the plurality of spray nozzles are arranged directed radially toward a rotation axis of the at least one component, and spaced apart along a circumferential direction of the at least one component.

11. The device according to claim 1, wherein:

the at least one holding device comprises a plurality of holding devices arranged on the transport device, the plurality of holding devices are structured and arranged for holding respectively at least one component, the plurality of holding devices are arranged next to one another with respect to the relative motion between the at least one print bar and the at least one holding device, and the plurality of holding devices are rotatable by respective rotation devices, which rotation devices are synchronously controllable.

12. The device according to claim 1, wherein:

the at least one print bar comprises a plurality of print bars arranged one behind the other in the direction of the relative motion between the at least one print bar and the at least one holding device, each print bar is adjustable in height relative to the at least one holding device and is pivotable about an axis parallel to the direction of the relative motion, and the at least one holding device is adjustable in height relative to the transport device and is pivotable about an axis parallel to the direction of the relative motion, so that surface regions of the at least one component that are tilted differently with respect to a reference plane, are simultaneously printable by different print bars.

13. A method for printing at least one component using a digital printing method, comprising:

arranging at least one component in at least one holding device structured and arranged for holding the at least one component;

controlling a transport device to generate a linear relative motion between at least one print bar with a plurality of spray nozzles and the at least one holding device;

printing a predetermined pattern on a surface of the at least one component with the at least one print bar as the linear relative motion is generated; and rotating the at least one component with a rotation device through an angle of rotation to present another surface of the at least one component for printing by the least one print bar.

14. A device for printing at least one component using a digital printing method, comprising:

at least one print bar with a plurality of spray nozzles for electronically controlled spraying of coloring liquid;

at least one holding device structured and arranged for holding the at least one component;

a transport device for generating a linear relative motion between the at least one print bar and the at least one holding device directed approximately perpendicular to a spray direction of the plurality of spray nozzles;

a control device, with which the transport device and the plurality of spray nozzles can be controlled such that the at least one component is printed with a predetermined pattern; and a rotation device controllable by the control device, and structured and arranged to rotate the at least one component through an angle of rotation about a rotation axis to orient at least one surface of the at least one component to be substantially perpendicular to the spray direction of the spray nozzles.

* * * * *